US011359457B2

(12) United States Patent
Kent et al.

(10) Patent No.: US 11,359,457 B2
(45) Date of Patent: Jun. 14, 2022

(54) DOWNHOLE WELL COMPLETION SYSTEM

(71) Applicant: Bossa Nova AS, Indre Arna (NO)

(72) Inventors: Anthony Kent, Houston, TX (US); Jan Tore Overanger, Garnes (NO)

(73) Assignee: Bosse Nova AS, Indre Arna (NO)

( * ) Notice: Subject to any disclaimer, the term of this patent is extended or adjusted under 35 U.S.C. 154(b) by 0 days.

(21) Appl. No.: 16/978,741

(22) PCT Filed: Mar. 8, 2019

(86) PCT No.: PCT/NO2019/050054
§ 371 (c)(1),
(2) Date: Sep. 7, 2020

(87) PCT Pub. No.: WO2019/172780
PCT Pub. Date: Sep. 12, 2019

(65) Prior Publication Data

US 2021/0095543 A1 Apr. 1, 2021

(30) Foreign Application Priority Data

Mar. 8, 2018 (NO) ..... 20180339

(51) Int. Cl.
*E21B 34/10* (2006.01)
*E21B 43/12* (2006.01)
(Continued)

(52) U.S. Cl.
CPC ..... *E21B 34/10* (2013.01); *E21B 43/12* (2013.01); *E21B 23/04* (2013.01); *E21B 43/14* (2013.01)

(58) Field of Classification Search
CPC ..... E21B 34/10; E21B 34/102; E21B 2200/06
See application file for complete search history.

(56) References Cited

U.S. PATENT DOCUMENTS 6,247,536 B1 6/2001 Leismer et al.
6,595,296 B1 7/2003 French
(Continued)

FOREIGN PATENT DOCUMENTS

WO WO 2014/114510 A2 7/2014

*Primary Examiner* — Cathleen R Hutchins
(74) *Attorney, Agent, or Firm* — Phillip Black; Dossey & Jones PLLC

(57) ABSTRACT

Downhole well completion system for control of flow to or from multiple compartments (1*a*,1*b*,1*c*,1*d*) in a targeted subterranean reservoir (30), comprising a plurality of interval control valves (2) connected in series forming a downhole string (24), said interval control valves (2) are manipulated from surface via hydraulic control lines (4*a*, 4*b*, 4*c*) to open or close flowports (20) of each interval control valve (2), wherein each interval control valve (2) comprises a command module (5) connected to at least two of said hydraulic control lines (4*a*, 4*b*), a first hydraulic control line is a command line (4*a*) to deliver applied pressure to the command module (5), which translates hydraulic pressure signals into axial movement of an inner ratchet rod (6) that determines the position of an integral pilot valve (7), a second hydraulic control line is a common-open or common-close line (4*b*), to provide hydraulic power to either open or close the flowports (20) of each interval control valve (2), and the inner ratchet rod (6) comprises several ratchet teeth (12), wherein the spacing of the ratchet teeth (12) determines the level of pressure, that must be applied to cause a command pawl (11) to engage the next ratchet teeth (12).

16 Claims, 5 Drawing Sheets

(51) Int. Cl.
*E21B 23/04* (2006.01)
*E21B 43/14* (2006.01)

(56) References Cited

U.S. PATENT DOCUMENTS

| | | | | |
|---|---|---|---|---|
| 2002/0046843 | A1 | 4/2002 | Rayssiguier et al. | |
| 2006/0278399 | A1 | 12/2006 | Dwivedi et al. | |
| 2008/0001111 | A1* | 1/2008 | Ross | E21B 23/04 251/230 |
| 2009/0243875 | A1 | 10/2009 | Mandrou et al. | |
| 2012/0073829 | A1 | 3/2012 | Smith et al. | |
| 2015/0129196 | A1* | 5/2015 | Jones | E21B 34/10 166/66.6 |
| 2016/0003005 | A1* | 1/2016 | Pickle | E21B 34/10 166/374 |

* cited by examiner

DOWNHOLE WELL COMPLETION SYSTEM

FIELD OF THE INVENTION

The present invention relates to a downhole well completion system for control of flow to or from multiple compartments in a targeted subterranean reservoir, comprising a plurality of interval control valves connected in series forming a downhole string, said interval control valves are manipulated from surface via hydraulic control lines to open or close flowports of each interval control valve.

BACKGROUND OF THE INVENTION

There are a variety of reasons to compartmentalize multiple intervals (zones) within a single well, including but not limited to: Better distribution of stimulation fluids across a long reservoir section, selective distribution of injected fluids, selective production of hydrocarbons, isolation of water-swept intervals, to prevent crossflow between or enable strategic choking of reservoir layers with different properties. Zones are either isolated, choked or opened by using sliding sleeves called interval control valves (ICVs). These ICVs are manipulated from surface via small metal conduits called control lines. The control lines can convey hydraulic fluids or electrical power which drives the ICV sleeve up or down to expose or isolate flowports in the ICV housing. Mechanical intervention is the only alternative to control flow from compartments. The ability to remotely operate the ICVs without intervention is especially important in fields where intervention costs are high, such as offshore, subsea environments. The result is that the exploration & production company/operator can deplete a field with fewer wells, which has an enormous impact on the commerciality of a hydrocarbon asset.

DISCLOSURE OF THE STATE OF ART

The solutions currently available in the industry can be placed into three categories: Hydraulic, electro-hydraulic and electric. The hydraulic systems are primarily limited by the number of different hydraulic control lines that can penetrate the tubing hanger, which results in a limitation in the number of zones the system can control independently. The best hydraulic systems available can control up to 12 zones with 4 hydraulic lines. Hydraulic systems are the dominant form of smart well control systems as the component reliability and life expectancy exceeds current electrical systems. However, the industry is taking steps towards electrical systems because they enable higher zone counts with less number of lines penetrating the tubing hanger. The electro-hydraulic systems typically rely on two hydraulic lines to provide energy for opening and closing ICVs, with one electrical line that controls solenoids to determine which ICV will be opened or closed when pressure is applied to the hydraulic lines. Electro-hydraulic systems are being advertised as capable of controlling up to 24 ICVs with the three lines. The pure electrical system on the market is claimed to control up to 40 ICVs with only one electrical line. The major downside of the electrical system is that the downhole electric motors cannot deliver much axial force and therefore are not capable of driving a full-size ICV. The electric-motor-driven ICVs have very small openings and are typically only appropriate for flow rates less than about 2000 liquid barrels per day. Most offshore field development is aimed at high flow rate wells, greater than 10000 liquid barrels per day, so although the operators may want higher zone counts, they are unable to utilize the pure electric control systems. Power requirements further complicate and limit the applicability of electrical control systems in deep-water environments.

US20060278399A1 discloses a multi-drop flow control valve system with multiple banked ICVs operated with a single control line. Each ICV includes biasing mechanism with a spring that causes each ICV to respond to a specific predetermined pressure.

U.S. Pat. No. 6,575,237B2 discloses a well dynamics hydraulic well control system, wherein digi-hydraulics creates a unique code by changing the sequence in which multiple hydraulic lines are pressurized.

U.S. Pat. No. 6,179,052B1 discloses a well dynamics digital-hydraulic well control system, wherein digi-hydraulics creates a unique code by changing the sequence in which multiple hydraulic lines are pressurized. Each unique sequence drives pilot valves such that only one of a multitude of ICVs is activated. The present invention differs from the digi-hydraulics in that it recognizes a unique sequence of pressure pulses sent down only a single hydraulic command line.

U.S. Pat. No. 7,013,980B2 discloses a hydraulically actuated control system for use in a subterranean well, and describes a command module that can be paired with an ICV to provide incremental actuation of the ICV, rather than having binary fully open or closed positions. The present invention could be used in combination with the incremental actuation command module to enable variable choking positions of an ICV via the same three lines described in the preferred embodiment.

U.S. Pat. No. 6,247,536B1 discloses a downhole multiplexer and related methods, and describes a hydraulic multiplexer that translates pressure signals into axial movement of an indexing mechanism, the extent of said axial movement determining which of a plurality of downhole tools is activated. The present invention differs from the multiplexer in that it enables selective control using a single command line without use of an indexing mechanism, the function of which has been the source of problems in related field applications.

WO2002020942A1 discloses a hydraulic control system for downhole tools, and describes a control module that responds to either differential pressure applied between to control lines from surface or pressure applied to a single control line against a biasing mechanism. The control module responds by aligning a third and fourth line with one of several outlets which are connected hydraulically to a similar number of well tool assemblies. The primary difference between the present invention is that the present invention describes a unique command module that is to be paired with each well tool assembly, or ICV, and receives pressure signals through three common lines which run from surface to each tool rather than a single command module that aligns a plurality of hydraulic control lines with a plurality of well tool assemblies.

U.S. Pat. No. 8,776,897B2 discloses a method and apparatus for multi-drop tool control, and describes the use of hydraulic switches and check valves to direct hydraulic pressure to a plurality of ICVs. It is similar to that of U.S. Pat. No. 6,575,237B2 and U.S. Pat. No. 6,179,052B1 in that the ICV selected for operation depends on the order in which the control lines are pressurized rather than, as in the present invention, relying on a single control line to selectively activate a pilot valve that enables ICV operation.

OBJECTS OF THE PRESENT INVENTION

In upstream oil & gas industry, to provide a downhole well completion equipment used for control of flow to or from multiple compartments (or zones) in a targeted subterranean reservoir.

A particular object is to provide three-line hydraulic control architecture for unlimited number of interval control valves.

A further object is to provide downhole well completion system as indicated above.

SUMMARY OF THE INVENTION

The invention relates to a downhole well completion system for control of flow to or from multiple compartments in a targeted subterranean reservoir, comprising a plurality of interval control valves connected in series forming a downhole string. Said interval control valves are manipulated from surface via hydraulic control lines to open or close flowports of each interval control valve. Wherein

- each interval control valve comprises a command module connected to at least two of said hydraulic control lines,
- a first hydraulic control line is a command line to deliver applied pressure to the command module, which translates hydraulic pressure signals into axial movement of an inner ratchet rod that determines the position of an integral pilot valve,
- a second hydraulic control line is a common-open or common-close line, respectively, to provide hydraulic power to either open or close the flowports of each interval control valve, and
- the inner ratchet rod comprises several ratchet teeth, wherein the spacing of the ratchet teeth determines the level of pressure, that must be applied to cause a command pawl to engage the next ratchet teeth.

Alternative embodiments are defined in the dependent claims.

The spacing of the ratchet teeth may determines the level of pressure, low or high, that must be applied to cause a command pawl to engage the next ratchet teeth.

A third hydraulic control line can be a common-open or common-close line.

The command module can comprise a compression chamber being pressurized by a command piston, wherein said command piston is forced axially by hydraulic fluid supplied via the command line.

The command piston can comprises the command pawl that can engage with ratchet teeth on the inner ratchet rod to prevent relative movement when pressure is relieved.

The compression chamber can be a closed volume and can be filled with a compressible fluid.

The compression chamber can comprises a command spring for returning the command piston to its starting position, when pressure is relieved, the command piston can be locked to the inner ratchet rod by the command pawl and ratchet teeth.

By varying the spacing of the ratchet teeth a unique pressure signatures can be generated to which the command module can respond and activate the pilot valve accordingly.

The number of ratchet teeth can determine the number of unique pressure signals that can be used to activate the pilot valves and the number of individual internal control valves that can be controlled selectively.

To return all of the command modules in the system to the starting position, allowing the unique pressure signatures to be repeated as necessary to activate the desired pilot valve, a high pressure reset can be achieved by applying a high pressure, above a determined threshold, to the command line, wherein axial movement of the command piston that can be caused by the high pressure results in the command pawl can be depressed by a reset edge.

A shoulder on the command piston can displace the ratchet rod such that an activated pilot valve is deactivated during the high pressure reset.

In the reset position, the command pawl can be disengaged from the ratchet teeth and low pressure applied to the common-close line can cause the inner ratchet rod to shift in reverse direction relative to the command piston until it shoulders against an internal part of the command module housing.

When pressure is relieved after the high pressure reset, the command spring can return both the command piston and the inner ratchet rod to the starting position.

The command unit can further comprises a reset spring wherein the reset spring can return the ratchet rod to the starting position during a high pressure reset, and

- a retainer pawl, fixed to the command module housing can prevent the ratchet rod from being returned to the starting position by the reset spring before the high pressure reset.

The retainer pawl can retain the ratchet rod by engaging with the ratchet teeth and a high pressure reset disengages the retainer pawl from the ratchet teeth.

The retainer pawl can be disengaged from the ratchet teeth by pushing a releasing member against the retainer pawl so the retainer pawl rotates and disengages the ratchet teeth, the releasing member moves with the command piston.

DESCRIPTION OF THE DIAGRAMS

Embodiments of the present invention will now be described, by way of example only, with reference to the following diagrams, wherein.

DESCRIPTION OF PREFERRED EMBODIMENTS OF THE INVENTION

The present invention relates to a downhole well completion system whereby flow to or from multiple reservoir compartments is controlled by interval control valves (ICVs) that are activated (opened or closed) remotely from surface by hydraulic pressure through three hydraulic control lines.

Figure 1:
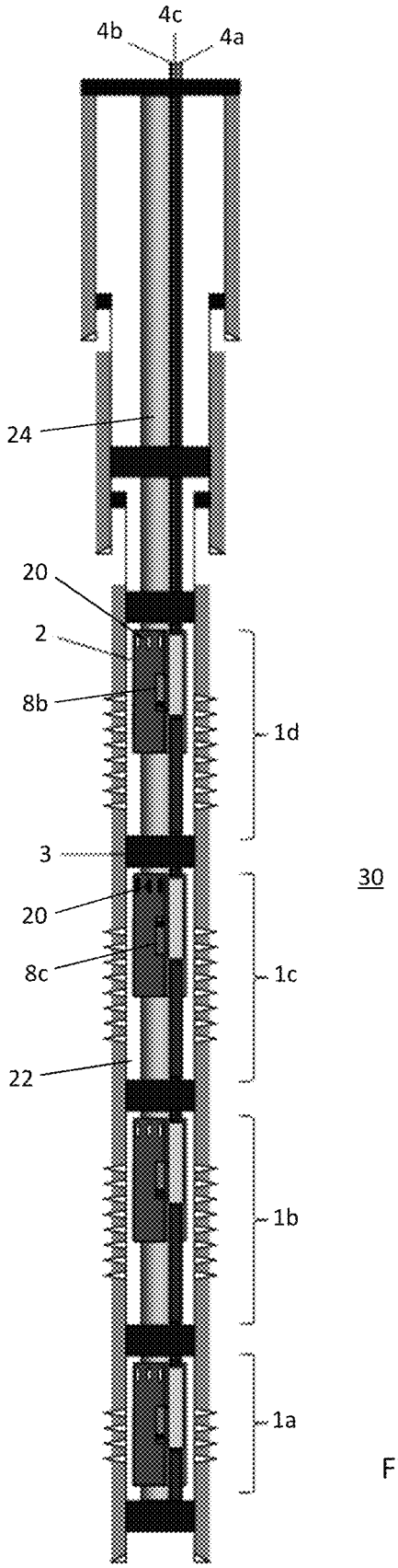
FIG. 1 shows a downhole well completion string with a plurality of interval control valves in a reservoir.

The present invention relates to a lower completion system with multiple compartments 1*a*, 1*b*, 1*c*, 1*d* from which flow is controlled by opening or closing interval control valves 2 (ICVs). There is typically one interval control valve 2 per compartment. An annular space 22 is isolated between compartments 1*a*, 1*b*, 1*c*, 1*d* using isolation packers 3. Flowports 20 in each interval control valve 2 are opened or closed by a displaceable sliding sleeve operated by a hydraulic piston. As seen in FIG. 1 the flowports 20 in the interval control valve 2 in compartment 1*c* is closed by the sleeve, while the flowports 20 in the interval control valves 2 of the other compartments 1*a*, 1*b*, and 1*d* are open.

With the present invention it is possible to selectively operate an unlimited number of interval control valves 2 using only three hydraulic lines 4*a*, 4*b*, 4*c* that run the length of the entire downhole string 24 from surface to the deepest interval control valve 2. The three hydraulic lines 4*a*, 4*b*, 4*c* pass through all the other components in the downhole string 24 via feedthroughs or bypass slots. The three hydraulic lines 4*a*, 4*b*, 4*c* are connected in series with each interval control valve 2 via a command module 5. One of the three hydraulic lines, i.e. a command line 4*a*, delivers applied pressure to the command modules 5 which translates the hydraulic pressure signals into axial movement of an inner ratchet rod 6 that determines the position of an integral pilot valve 7.

Figure 2:
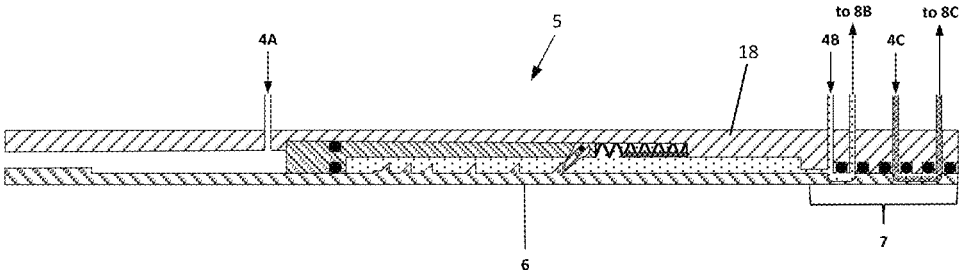
FIG. 2-9 show one embodiment of a command module for an interval control valve at different settings. The command module is shown in cross-section.

The other two hydraulic lines, called common-open and common-close lines 4*b*,4*c*, respectively, provide hydraulic power to either open or close the interval control valves 2, respectively. The pilot valve 7 separates the common-open and common-close lines 4*b*,4*c* from the open and close chambers, 8*b* and 8*c* respectively, of the interval control valve 2 piston. The chambers 8*b* and 8*c* are connected to a hydraulic piston operating the interval control valve 2. When the pilot valve 7 is activated, FIG. 2, the two common lines 4*b*,4*c* are connected to the respective chambers 8*b*,8*c* and pressure applied from surface to one of the lines will cause the interval control valve hydraulic piston to shift in the respective direction, thereby either opening or closing the flowports 20 of the interval control valve 2.

Figure 3:
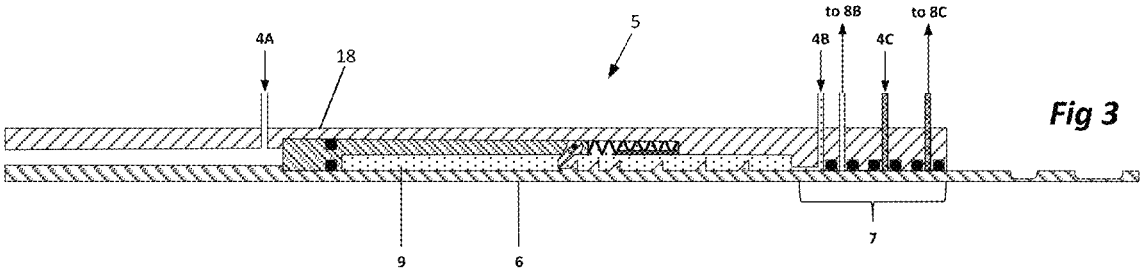
Figure 4:
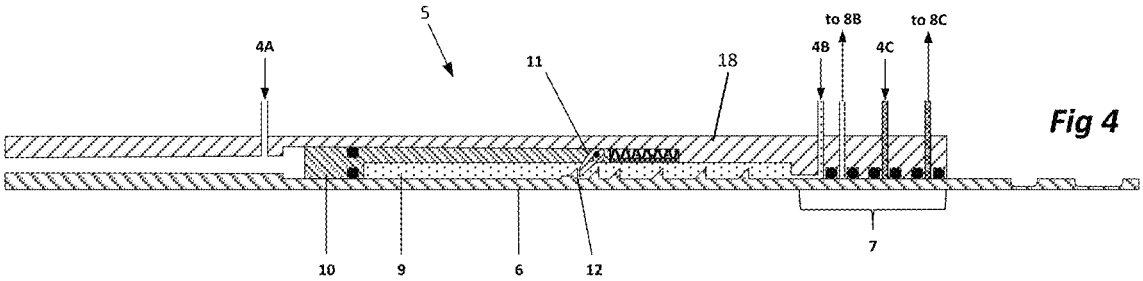
Figure 5:
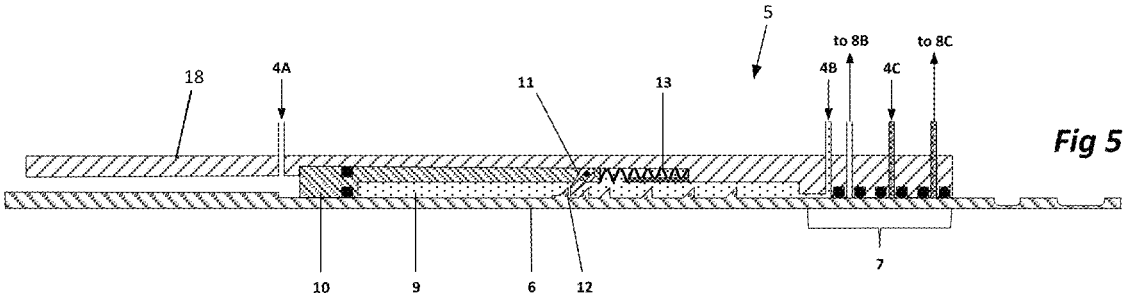

Prior to being activated, FIG. 3, the pilot valve 7 prevents any pressure that is applied to the common lines 4*b*,4*c* from being transferred to either of two interval control valve piston chambers, 8*b* and 8*c*, in turn preventing any interval control valve 2 movement. One command module 5 is associated with each interval control valve 2. Each command module 5 has the compression chamber 9 which compresses in volume with applied pressure on the command line 4*a*, FIG. 4. The higher the applied pressure, the more compression occurs. This compression relates to axial movement of a command piston 10. The command piston 10 moves axially relative to the inner ratchet rod 6 when pressure is applied. Command pawl 11 on the command piston 10 will engage the ratchet teeth 12 on the inner ratchet rod 6 and prevent relative movement of the two pieces when pressure is relieved. When pressure is relieved, a command spring 13 returns the command piston 10, which is locked to the inner ratchet rod 6, to its starting position, FIG. 5. In this manner, multiple cycles of applied pressure followed by pressure relief results in axial movement of the inner ratchet rod 6 in one direction only.

Figure 6:
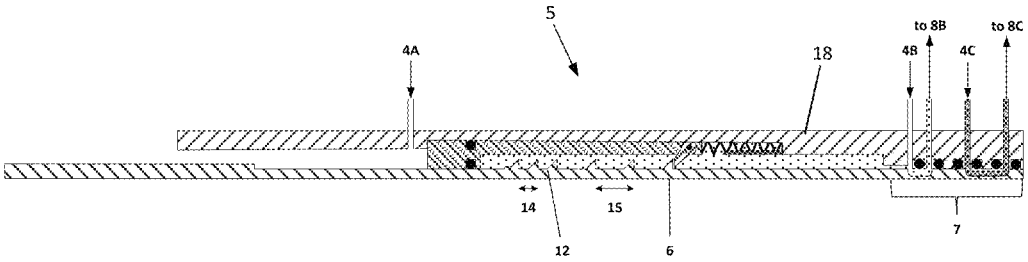

At the end of the axial movement of the inner ratchet rod 6, the pilot valve 7 is activated, FIG. 6, and the common-open and -close lines 4*b*,4*c* are connected with the open and close chambers 8*b*,8*c* of the interval control valve 2. The spacing of the ratchet teeth 12 determines the level of pressure, low or high (14 and 15, respectively), that must be applied to cause the command pawl 11 to engage the next teeth 12. As such, by varying the spacing of the ratchet teeth 12, one can create unique pressure signatures to which the command module 5 will respond and activate the pilot valve 7 accordingly.

Figure 7:
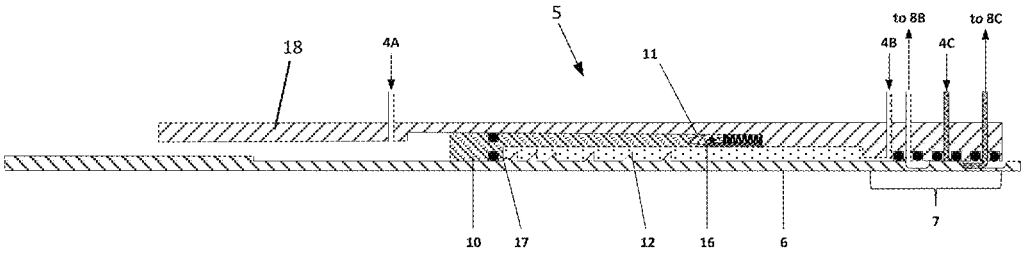
Figure 8:
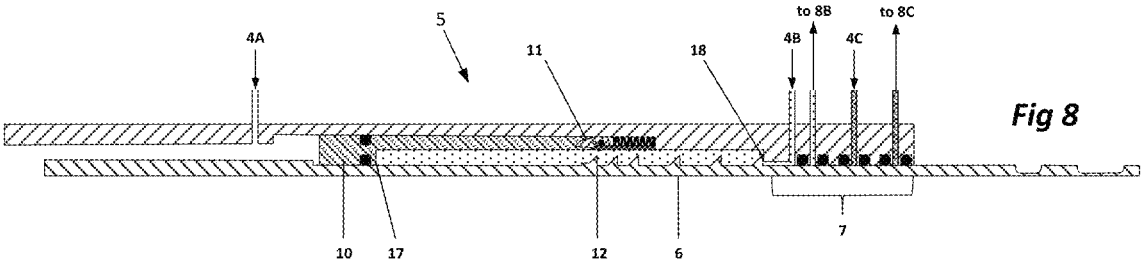
Figure 9:
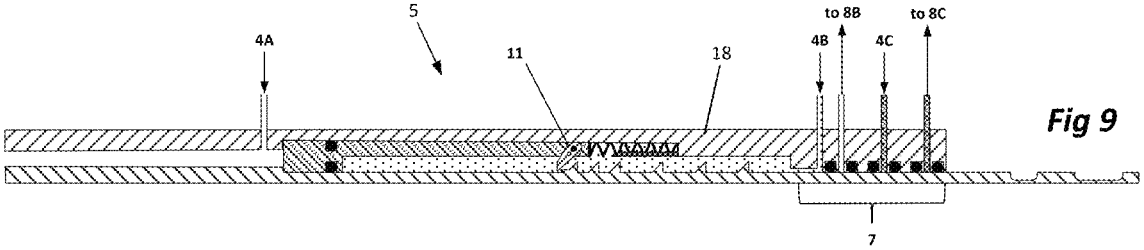

A high pressure reset is necessary to return all of the command modules 5 in the system to the starting position, allowing the unique pressure signatures to be repeated as necessary to activate the desired pilot valve 7. The high pressure reset, FIG. 7, is achieved by applying a high pressure, above a determined threshold, to the command line 4*a*. The axial movement of the command piston 10 caused by the high pressure results in the command pawl 11 to be depressed by a reset edge 16 on the piston housing. A shoulder 17 on the command piston 10 also displaces the ratchet rod 6 such that an activated pilot valve 7 is deactivated during the high pressure reset. In the reset position, the command pawl 11 are disengaged from the ratchet teeth 12 and low pressure applied to the common-open line 4*c* will cause the inner ratchet rod 6 to shift in reverse direction relative to the command piston 10 until it shoulders against an internal part of the command module housing 18, FIG. 8. When pressure is relieved after the high pressure reset, the spring 13 returns both the command piston 10 and inner ratchet rod 6 to the starting position, FIG. 9.

In an alternative embodiment, the compression chamber 9 can be a closed volume filled with compressible fluid which will allow the compression of the compression chamber 9 in proportion to the compressibility of the fluid and the pressure applied to the command line 4*a*.

In the described manner, the selective control of pilot valves 7 depends on the hydraulic input pressure signals to match that of the ratchet teeth 12 spacing in the targeted command module 5. The number of ratchet teeth 12 determines the number of unique pressure signals that can be used to activate the pilot valves 7 and therefore the number of individual ICVs 2 that can be controlled selectively. With six ratchet teeth 12 on each command module inner ratchet rod 6, as illustrated in the figures, the maximum number of ICVs that can be selectively operated is 20. However, this invention is not limited to six ratchet teeth 12 or pressure cycles; the number of ratchet teeth can be increased or decreased as necessary to enable control of more or fewer number of ICVs, respectively. The invention is neither limited to only two pressure levels in addition to a high pressure reset.

Figure 10:
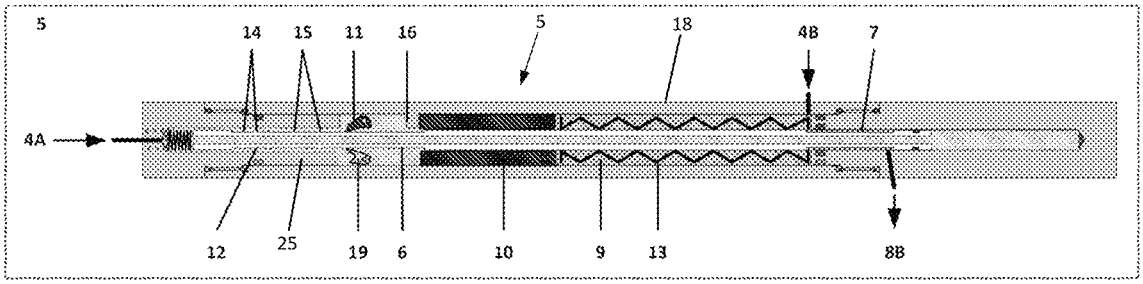
FIG. 10-16 show another embodiment of a command module for an interval control valve. The command module is shown in cross-section.

In a second embodiment, FIG. 10, the pilot valve 7 separates only one of the common lines, such as 4*b*, from the respective chamber 8*b* of the interval control valve 2 piston. The other common line, in this case 4*c*, would bypass the command module 5 and be connected directly to the chamber 8*c*, which in turn is connected to one side of a hydraulic piston operating the interval control valve 2. The chamber 8*b* is connected to the other side of a hydraulic piston operating the interval control valve 2. When the pilot valve 7 is activated, FIGS. 10 and 14, the common line 4*b* is connected to the respective chamber 8*b* and pressure applied from surface to one of the lines will cause the interval control valve hydraulic piston to shift in the respective direction, thereby either opening or closing the flowports 20 of the interval control valve 2. If the pilot valve 7 is not activated, pressure applied from surface on line 4*b* will be isolated from the respective chamber 8*b* and will therefore cause no movement of the interval control valve 2 hydraulic piston. In a similar manner, if the pilot valve 7 is not activated, pressure applied from surface on line 4*c* will cause no movement of the interval control valve 2 hydraulic piston because the return fluid in chamber 8*b* is hydraulically locked by the closed pilot valve 7.

Figure 11:
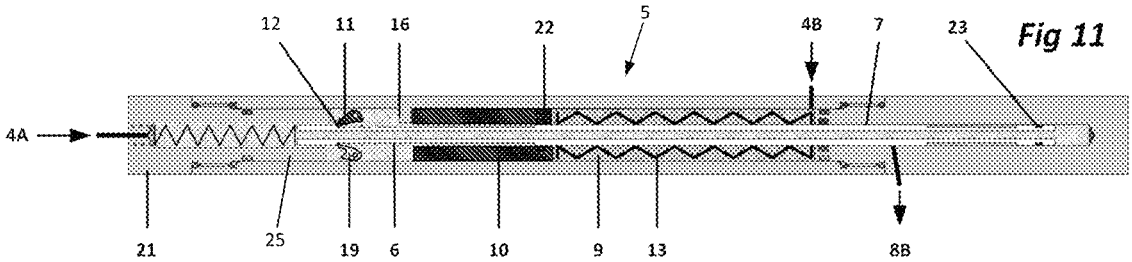

FIG. 11 shows the second embodiment in starting position. The command pawl 11 rests in the first ratchet rod tooth 12. The common line 4B is isolated from the hydraulic chamber 8B, which is connected to one side of the interval control valve 2 piston. The command piston 10 separates the command line 4A pressure from the common line 4B pressure. The command piston 10 is physically connected to the command pawl 11 and moves in unison. A retainer pawl 19 is physically connected to the command module housing 18. The rod 6, 7 (ratchet rod 6 and pilot valve 7) allows pressure communication through its bore. Seal diameters and area in opposite ends of the rod 6, 7 is equal, resulting in no net force on the pilot valve 7 and ratchet rod 6 when pressure is applied to command line 4A.

When pressure is applied to command line 4A (FIG. 12), the command piston 10 compresses the command spring 13 and results in relative movement of the command pawl 11 against the ratchet rod 6. The retainer pawl 19 prevents the reset spring 21 from driving the ratchet rod 6 in the same direction as the command piston 10. The axial displacement of the command piston 10 is relative to the spring constant of the command spring 13 and the difference between the command line 4A pressure and the common line 4B pressure. If the resulting axial movement of the command piston 10 is such that the command pawl 11 passes a tooth 12 on the ratchet rod 6, the command pawl 11 will engage the tooth 12.

When pressure on command line 4A is bled off and ventilated (FIG. 13), the command spring 13 returns the command piston 10 back to the starting position and the engaged command pawl 11 and the ratchet rod 6 also return the same axial distance. The reset spring 21 is compressed by the greater force transferred through the ratchet rod 6, the command pawl 11 and the command spring 13.

Figure 12:
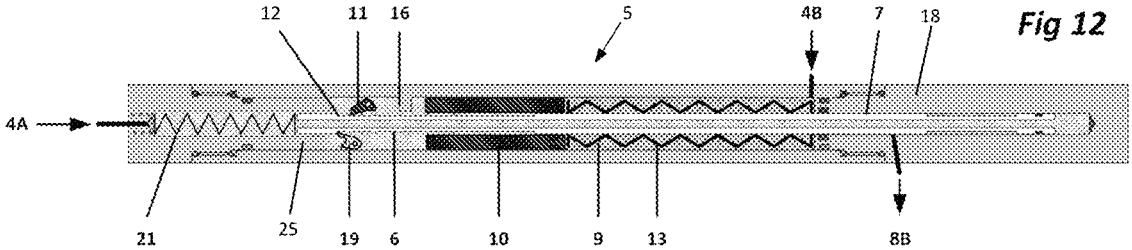
Figure 13:
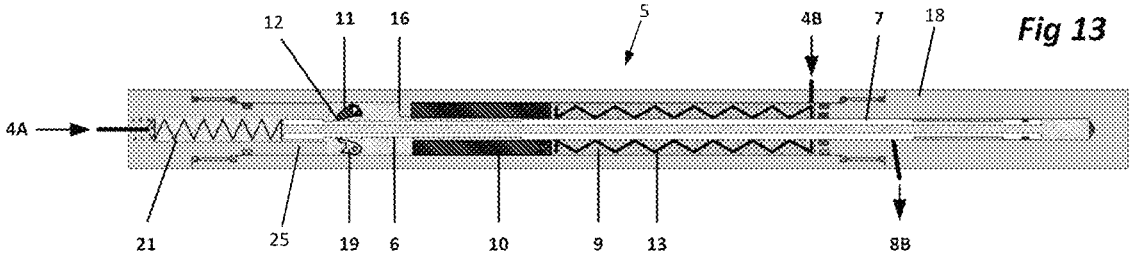

The pressure sequence illustrated in FIG. 12 and FIG. 13 represents one cycle of the command module. In this embodiment, six cycles must be completed before the pilot valve 7 is activated. The successful completion of a cycle is contingent on the resulting axial displacement of the command piston 10 and command pawl 11 being equal to or greater than the spacing between the tooth engaged by the retainer pawl 19 and the next tooth on the ratchet rod 6 on the side of the command piston 10. Should the axial displacement of the command piston 10 not be sufficient to engage the next tooth on the ratchet rod 6, no movement of the ratchet rod 6 will occur when pressure is bled off on the command line 4A and the command piston 10 and the command pawl 11 will return.

Figure 14:
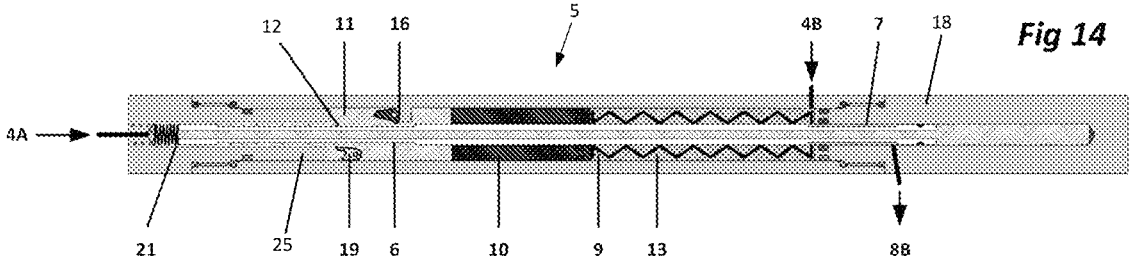
Figure 15:
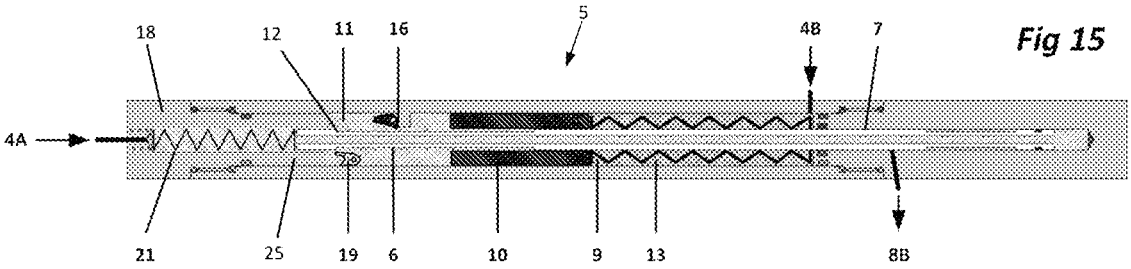

After six successful pressure cycles are completed, the command module will be positioned as illustrated in FIG. 10, allowing pressure to communicate between the common line 4B and the respective interval control valve 2 piston. To reset the command module 5 to its starting position, high pressure must be applied to the command line 4A such that the axial displacement of the command piston causes the command pawl 11 to engage the reset edge 16 and disengage from the ratchet teeth of the ratchet rod 6 (FIG. 14). At the same time, a releasing member 25 causes the retainer pawl 19 to also disengage from the ratchet teeth of the ratchet rod 6. The releasing member 25 is physically connected to the command piston 10 and they moves in unison. With no teeth engaged on the ratchet rod 6, the reset spring 21 pushes the ratchet rod 6 and pilot valve 7 back to starting position (FIG. 15).

Figure 16:
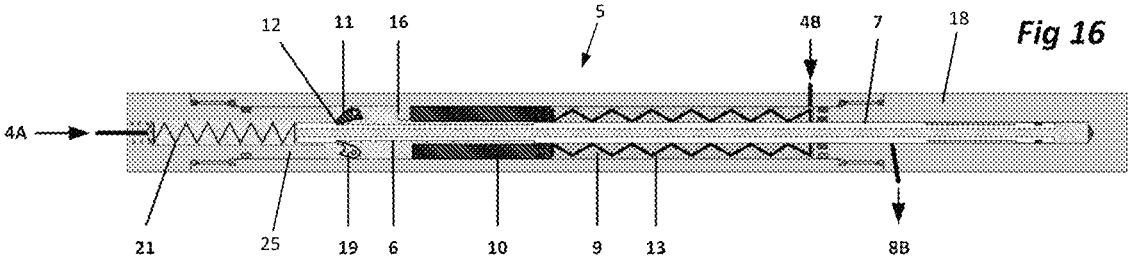

When pressure on the command line 4A is relieved (FIG. 16), the command spring 13 returns the command piston 10 and command pawl 11 back to the starting position. Both the command pawl 11 and retainer pawl 19 are now engaged back on the first tooth 12 of the ratchet rod 6.

The invention claimed is:

1. A downhole well completion system for control of flow to or from multiple compartments in a targeted subterranean reservoir, comprising:

a plurality of interval control valves connected in series forming a downhole string, said interval control valves being manipulated from the surface via hydraulic control lines to open or close flowports of each interval control valve, wherein each interval control valve comprises a command module connected to at least two of said hydraulic control lines, a first hydraulic control line comprise a command line (4*a*) to deliver applied pressure to the command module (5), which translates hydraulic pressure signals into axial movement of an inner ratchet rod (6) that determines the position of an integral pilot valve (7), a second hydraulic control line comprises a common-open or common-close line, to provide hydraulic power to either open or close the flowports of each interval control valve, and the inner ratchet rod comprises several ratchet teeth, wherein the spacing of the ratchet teeth determines the level of pressure that must be applied to cause a pivotable command pawl to engage the next ratchet teeth, said pivotable command pawl being disengageable from the inner ratchet rod.

2. The downhole well completion system according to claim 1, wherein the spacing of the ratchet teeth determines the level of pressure, low or high, that must be applied to cause a command pawl to engage the next ratchet teeth.

3. The downhole well completion system according to claim 1, wherein a third hydraulic control line comprises a common-open or common-close line.

4. The downhole well completion system according to claim 1, wherein said command module comprises a compression chamber pressurized by a command piston, wherein said command piston is forced axially by hydraulic fluid supplied via the command line.

5. The downhole well completion system according to claim 4, wherein said command piston comprises the command pawl for engagement with the ratchet teeth on the inner ratchet rod to prevent relative movement when pressure is relieved.

6. The downhole well completion system according to claim 4, wherein the compression chamber comprise a closed volume and is filled with a compressible fluid.

7. The downhole well completion system according to claim 4, wherein said compression chamber comprises a command spring for returning the command piston to its starting position when pressure is relieved, the command piston being locked to the inner ratchet rod by the command pawl and ratchet teeth.

8. The downhole well completion system according to claim 1, wherein the command module responds to unique pressure signatures that am generated by varying the spacing of the ratchet teeth and activates the pilot valve accordingly.

9. The downhole well completion system according to claim 8, wherein the number of ratchet teeth determines the number of unique pressure signals that can be used to activate the pilot valves and the number of individual internal control valves that can be controlled selectively.

10. The downhole well completion system according to claim 8, wherein to return all of the command modules in the system to the starting position, the desired pilot valve is activated via a high pressure reset carried out and achieved by applying a high pressure, above a determined threshold, to the command line and allowing the unique pressure signatures to be repeated as necessary to activate the desired pilot valve, wherein axial movement of the command piston caused by the high pressure results in the command pawl being depressed by a reset edge.

11. The downhole well completion system according to claim 10, wherein a shoulder on the command piston displaces the ratchet rod such that the activated pilot valve is deactivated during the high pressure reset.

12. The downhole well completion system according to claim 10, wherein when the command pawl is in the reset position, the command pawl is disengaged from the ratchet teeth and low pressure is applied to the common-close line to cause the inner ratchet rod to shift in reverse direction relative to the command piston until the inner ratchet rod shoulders against an internal part of the command module housing.

13. The downhole well completion system according to claim 10, wherein when pressure is relieved after the high pressure reset, the command spring returns both the command piston and the inner ratchet rod to the starting position.

14. The downhole well completion system according to claim 1, wherein the command unit further comprises:

a reset spring, wherein the reset spring returns the ratchet rod to the starting position during a high pressure reset, and a retainer pawl fixed to the command module housing that prevents the ratchet rod from being returned to the starting position by the reset spring before the high pressure reset.

15. The downhole well completion system according to claim 14, wherein the retainer pawl retains the ratchet rod by engaging with the ratchet teeth and a high pressure reset disengages the retainer pawl from the ratchet teeth.

16. The downhole well completion system according to claim 15, wherein the retainer pawl is disengaged from the ratchet teeth by pushing a releasing member that moves with the command piston against the retainer pawl so the retainer pawl rotates and disengages the ratchet teeth.

* * * * *